United States Patent [19]

Moreau

[11] 4,033,297

[45] July 5, 1977

[54] PROTECTION OF SUPERHEATER TUBES AGAINST CORROSION

[75] Inventor: André Moreau, Paris, France

[73] Assignee: Electricite de France (Service National), Paris, France

[22] Filed: Mar. 12, 1976

[21] Appl. No.: 666,491

[30] Foreign Application Priority Data

Mar. 28, 1975 France ..... 75.09896

[52] U.S. Cl. ..... 122/476; 110/98 R; 427/180

[51] Int. Cl.[2] ..... F22G 3/00

[58] Field of Search ..... 110/97 R, 98 R; 122/6 A, 235 A, 476, 481; 427/180

[56] References Cited

UNITED STATES PATENTS

| | | | |
|---|---|---|---|
| 1,900,445 | 3/1933 | Jacobus et al. | 122/6 A |
| 2,293,735 | 8/1942 | Hardgrove | 122/6 A |
| 2,869,521 | 1/1959 | Hardgrove | 122/481 |

*Primary Examiner*—Kenneth W. Sprague
*Attorney, Agent, or Firm*—Parmelee, Miller, Welsh & Kratz

[57] ABSTRACT

This invention relates to panels comprising a rigidly interconnected set of metal tubes with a continuous sheet of a refractory lining material which has a satisfactory thermal conductivity and is chemically inert with respect to combustion products covering at least a portion of the surface of the set of tubes, the lining material including a binder which provides the sheet with resistance to collapse in the cold state. Such panels are of particular value in recuperation boilers which burn fuels such as domestic garbage, industrial waste or waste oil.

13 Claims, 4 Drawing Figures

PROTECTION OF SUPERHEATER TUBES AGAINST CORROSION

This invention relates to superheater tubes for boilers, and in particular to the protection of sets of tubes against the corrosive action of substances produced during combustion in boilers.

Corrosion of superheater tubes occurs in conventional boilers fired by coal, fuel oil, etc., and even more so in recuperation boilers which burn fuels such as waste oil, domestic garbage or industrial waste. Various methods of preventing corrosion of the tubes by noxious gases, or by molten residues which settle on the tubes, have been proposed, in particular:

covering of the tubes completely with a coating of chromium (chromium plating);

metallisation of the tubes with a metal powder using a torch; and tube enamelling.

These three methods have disadvantages. The coatings in all three cases are fragile or porous, and do not withstand shocks (for example during installation). Spalling occurs, which results in a failure to provide long-term protection.

It has also been proposed to protect such tubes with shells or shields, that is to say metal plates positioned in front of the tubes which prevent residues settling thereon and prevent gas-flow towards the tubes. This interposing of a heat screen between the heat source and the tubes reduces the efficiency of the superheater. Moreover, the durability of the shield is limited.

Another hitherto proposed method is to use a coating of a substance which neutralises the noxious gases. For example, dolomite, magnesia, copper sulfate, steam, etc., have been proposed for the purpose, but although they reduce the speed of corrosion they do not contain it.

It is an object of the present invention to provide an improved method of protecting panels of such tubes against corrosion without unduly complicating the manufacture or installation of the panels.

According to the present invention there is provided a method of protecting a panel of tubes for a boiler superheater against corrosion, which comprises coating at least a part of the surface of the panel with a continuous sheet of a refractory lining material which has a satisfactory thermal conductivity and is chemically inert with respect to the products of combustion in the boiler, the lining material comprising a binder which provides the material with resistance to collapse in the cold state.

The invention further provides a panel of tubes for a boiler, the panel comprising a rigidly interconnected set of metal tubes with a continuous sheet of a refractory lining material which has a satisfactory thermal conductivity and is chemically inert with respect to combustion products covering at least a portion of the surface of the set of tubes, the lining material including a binder which provides the sheet with resistance to collapse in the cold state.

The tubes in the sets having a sheet of refractory lining material thereon should be rigidly joined to each other and sufficiently close to each other that a continuous sheet of adequate mechanical strength can be formed thereon.

Panels of superheater tubes embodying the invention will now be described, by way of example, with reference to the accompanying diagrammatic drawings in which.

Figure 1:
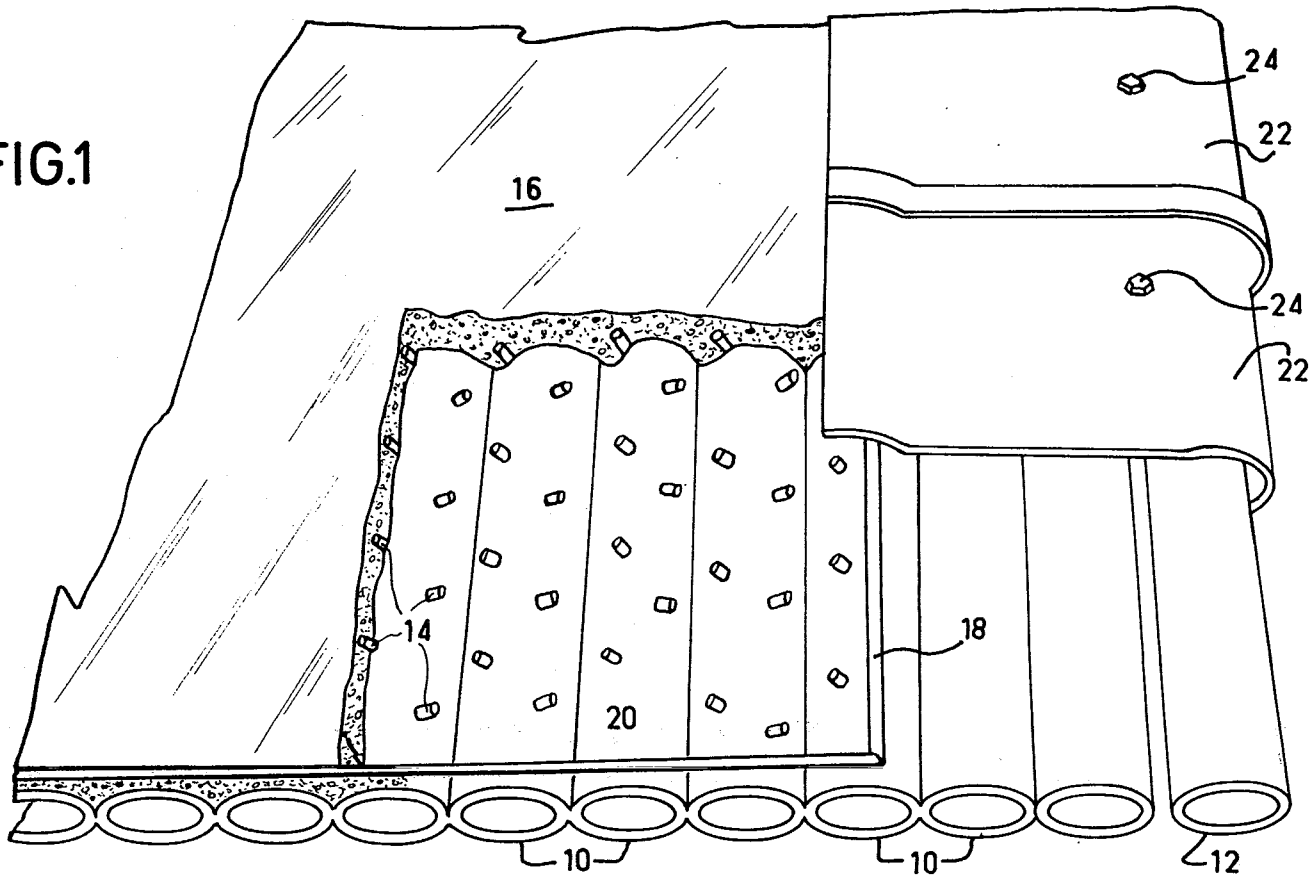
FIG. 1 is a part cutaway perspective view from above, of one panel of tubes having a continuous sheet of a refractory lining material thereon.

FIG. 1 shows a panel of metal tubes forming a boiler superheater. Tubes 10 are rigidly joined together side-by-side by seam welds, about 1 meter long, along their outer surfaces. End tube 12 is, however, spaced from the others to provide a passage for sheath fastening pins, which will be described hereinafter. The panel of tubes shown in FIG. 1 is flat, and has a major portion of at least one surface thereof covered by a coating sheet 16 of a refractory lining material. Sheet 16 is plane on its outer surface and fills the hollows and interstices between the tubes 10. In FIG. 1, sheet 16 is shown partly cut away, revealing a staggered pattern of projecting pegs or studs 14 welded to tubes 10, for anchoring sheet 16 to tubes 10. If studs 14 were absent, sheet 16 would not hold to the otherwise smooth surface of the tubes 10. Studs 14 are inclined to the plane of the panel of tubes 10, and they are completely covered by sheet 16.

The external surface of the panel of tubes is not completely covered by sheet 16. Sheet 16 is bounded by bars 18 and 20 welded to tubes 10 before the lining material is applied to form sheet 16. Bars 18 and 20 serve to prevent crumbling of the lining material at the edges of the sheet. Bar 18 is welded along an outer surface of one of the tubes 10, and bar 20, which is transverse to bar 18, interconnects tubes 10 and is spot-welded to each tube.

Sheet 16 does not cover the end tubes 12 and some of the outer tubes 10 of the panel, since it is preferable to cast a plane sheet of lining material and to protect the extremities of the panel in another manner. Sheaths 22 protect the extreme tubes, and they are secured by bolts 24 passing through a gap between end tube 12 and the adjacent tube 10. Sheaths 22 are preferably produced from a metal alloy having a high chromium content (at least 30%). Bar 18 forms a neat transition between the sheaths 22 and the surface of the lining material.

The hereinbefore described panel can be manufactured as follows. Bars 18 and 20 are welded on tubes 10. Sheet 16 is cast on the area defined by these bars, and, where desired, sheaths 22 are fitted on the extremities of the panel.

Figure 2:
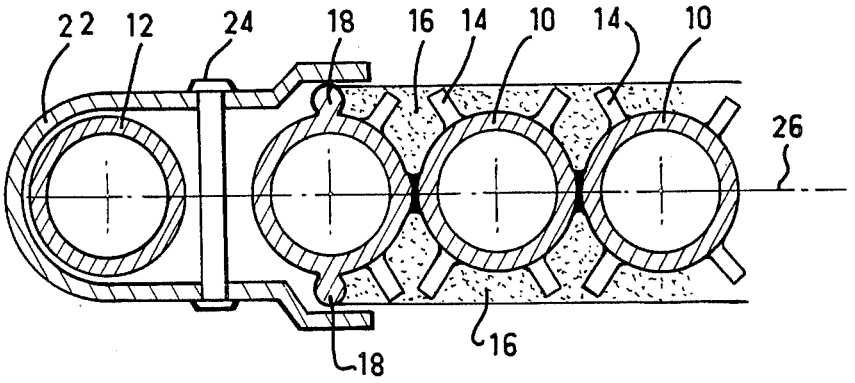
FIG. 2 is a section through the tubes of FIG. 1, in a plane at right angles to the longitudinal axes of the tubes.

FIG. 2 shows a section through the panel of FIG. 1 having both sides of the panel covered by a sheet 16 of lining material. Tubes 10 can be seen with their projecting studs 14 inclined to the plane of the panel (denoted by the chain line 26). Bars 18 are welded to opposite ends of an external diameter of one of the tubes. A sheath 22 is secured by bolts or pins 24 passing between one of the tubes 10 and the end tube 12, and the sheets 16 of lining material in planes parallel to the plane of the panel and on either side thereof, fills the gaps between the tubes 10 so as to produce an uninterrupted plane surface, instead of the undulating surface of the combination of tubes 10.

The refractory lining material used to produce sheet 16, and for protecting tubes 10 against corrosion, should have a satisfactory thermal conductivity, preferably exceeding 13 kilocalories per meter and per degree. Furthermore, it should have a satisfactory chemical inertia with respect to the products of combustion in the boiler, thereby serving to prevent corrosion by combustion gases as well as preventing the adhesion of residues, such as molten sulfates, on the surface of the panel.

Figure 3:
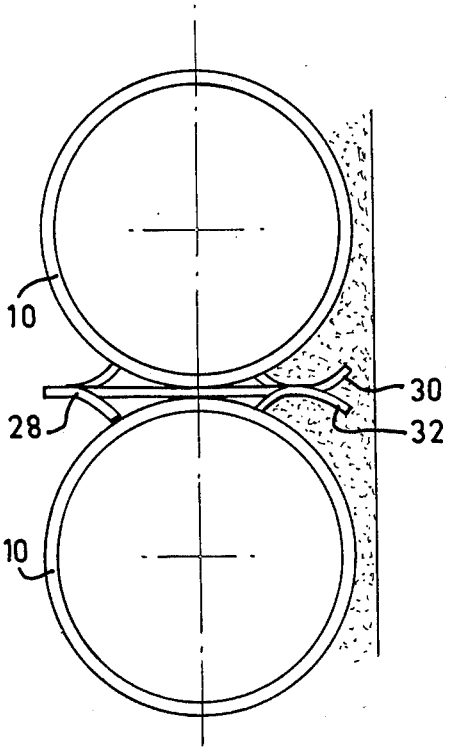
FIG. 3 is a section through another panel of tubes having a lining material secured by refractory steel clips.

The lining material desirably has a low porosity in order to prevent diffusion of gaseous combustion products through its thickness. The thickness of sheet 16 is preferably about 6 mm above the upper part of each tube 10. The lining material should also have a cold mechanical strength sufficient to allow the panels to be handled and placed in position without damaging them. The collapse threshold in the cold state and prior to firing preferably exceeds 200 $Kgs/cm^2$. The lining material should also be able to withstand scavenging with air or steam under pressure, without erosion. One preferred lining material is a phosphatic binder (for example aluminum monophosphate) or a binder comprising calcium aluminate, with a charge of silicon carbide or graphite.

Where the superheater tubes 10 are not welded together throughout their lengths, but are welded together at points with gaps between them, metal clips can be inserted into these gaps at regular intervals. Such clips can replace studs 14 of FIG. 1 to hold the sheet 16 of lining material anchored on the panel of tubes. This situation is illustrated in FIG. 3, wherein two tubes 10 are separated by a gap into which has been inserted a refractory steel clip 28. Clip 18 has curved portions 30 and 32 for anchoring the lining material. The elasticity of clips 28 allows them to be inserted and retained between the tubes 10.

Figure 4:
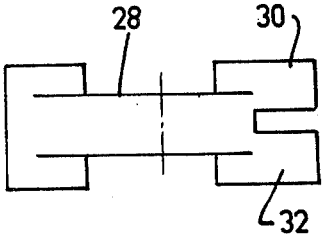
FIG. 4 is a plan of a clip as shown in FIG. 3.

FIG. 4 shows a plan view of a clip 28. This form of clip is of particular value when the tubes 10 cannot be provided with projecting studs 14 as in FIG. 2.

Methods of protection of panels of tubes for superheaters against corrosion employing the present invention can be used where the panels of tubes are accessible from only one side or where they are accessible from both sides. Compared with hitherto proposed methods, the present invention provides a high degree of mechanical rigidity, with a thick protective layer, without a substantial alteration in the transmission of heat to steam which traverses the tubes. It can also be used with panels of tubes which are not planar. However plane panels are relatively easy to manufacture since the lining material can be cast in a horizontal sheet which uniformly fills the hollows and gaps between the tubes.

An example of a composition for a lining material including a phosphatic binder is as follows:

80% of SiC, 7% of $Al_2O_3$, 8% of clay, and 5% of $Al(H_2PO_4)_3$.

An example of a composition for a lining material including a calcium aluminate binder is as follows:

81% of SiC, 11.54% of $Al_2O_3$, 0.47% of $SiO_2$, 0.06% of $Na_2O$, 5.30% of CaO, 1.23% of $Fe_2O_3$, and 0.4% of FeO.

Panels of tubes embodying the present invention are of particular value in recuperation boilers which burn fuels such as domestic garbage, industrial waste or waste oil.

I claim:

1. A method of providing a boiler superheater with tubes protected against corrosion comprising the steps of assembling tubes side to side so as to make a panel, coating at least a part of the surface of the panel with a continuous sheet of a refractory lining material which has a satisfactory thermal conductivity and is chemically inert with respect to the products of combustion in the boiler, the lining material including a binder which provides the material with resistance to collapse in the cold state, and then setting the coated panel of tubes inside the superheater at its required position.

2. A method according to claim 1, wherein a continuous sheet of a refractory lining material is formed on each side of the panel.

3. A method according to claim 1, wherein metal bars are welded onto the tubes prior to forming the sheet of refractory lining material to form an enclosure defining an area on which the sheet is subsequently applied.

4. A method according to claim 1, which comprises forming a distributed pattern of studs on the tubes for holding the lining material fast on the tubes.

5. A panel of tubes for a boiler, the panel comprising a rigidly interconnected set of metal tubes with a continuous sheet of a refractory lining material which has a satisfactory thermal conductivity and is chemically inert with respect to combustion products covering at least a portion of the surface of the set of tubes, the lining material including a binder which provides the sheet with resistance to collapse in the cold state.

6. A panel according to claim 5, wherein each metal tube has studs distributed over its surface and projecting into the sheet of lining material.

7. A panel according to claim 6, wherein the studs are inclined to the external surface of the lining material.

8. A panel according to claim 5, wherein the set of tubes is planar and the sheet of lining material has a plane external surface parallel to the plane of the set of tubes.

9. A panel according to claim 8, having refractory steel clips in gaps between adjacent tubes of the set for holding the lining material onto the tubes.

10. A panel according to claim 5, having bars welded on the set of tubes and surrounding the lining material covering the tubes, the bars being on at least one side of the set of tubes.

11. A panel according to claim 5, wherein the end portions of the panel are not covered with the lining material and including metal sheaths around the end tubes of the set for protecting said uncovered portions.

12. A panel according to claim 5, wherein the thickness of the lining material is approximately 6 mm where the external surface of the lining material is closest to the surface of the tubes.

13. A panel according to claim 5, wherein the lining material comprises silicon carbide or graphite, with aluminum monophosphate or calcium aluminate as a binder.

* * * * *